United States Patent [19]

Barthomeuf

[11] Patent Number: 4,659,294

[45] Date of Patent: Apr. 21, 1987

[54] HYDRUALIC PRESSURE AMPLIFIER

[75] Inventor: Jean-Claude S. Barthomeuf, Lucenay, Anse, France

[73] Assignee: Eimco Secoma, Societe Anonyme, Meyzieu, France

[21] Appl. No.: 817,360.

[22] Filed: Jan. 9, 1986

[30] Foreign Application Priority Data

Jan. 9, 1985 [FR] France ..... 85 00540

[51] Int. Cl.[4] ..... F04B 9/10

[52] U.S. Cl. ..... 417/397; 91/297; 91/320

[58] Field of Search ..... 417/393, 397, 402; 91/290, 297, 319, 320, 50

[56] References Cited

U.S. PATENT DOCUMENTS

| | | | |
|---|---|---|---|
| 2,300,110 | 10/1942 | De Hoog | 417/402 |
| 2,789,510 | 4/1957 | Meynig | 417/402 |
| 2,826,149 | 3/1958 | Wrigley | 91/319 X |
| 2,864,313 | 12/1958 | Dawson | 91/319 X |
| 3,655,300 | 4/1972 | Davis | 417/397 |
| 3,776,665 | 12/1973 | Dalton | 417/397 |
| 3,790,310 | 2/1974 | Whelan | 417/393 X |
| 4,102,609 | 7/1978 | Wood | 417/402 X |
| 4,281,587 | 8/1981 | Garcia-Crespo | 91/290 |

*Primary Examiner*—Leonard E. Smith

*Attorney, Agent, or Firm*—Karl F. Ross; Herbert Dubno

[57] ABSTRACT

A hydraulic pressure amplifier, e.g. for generating high water pressure for rock cutting and the like, in which a differentially displaced piston drives plungers alternately to pressurize the water and is driven by a primary fluid under the exclusively of a hydraulically displaceable pilot valve. The valve member is connected by a single pilot passage to the cylinder of the piston for switching between its positions.

13 Claims, 2 Drawing Figures

HYDRUALIC PRESSURE AMPLIFIER

FIELD OF THE INVENTION

My present invention relates to a hydraulic pressure amplifier, namely, a device which receives the energy from a hydraulic fluid under pressure, referred to as a primary fluid, and transfers this energy to another hydraulic fluid, referred to as a secondary fluid, in such a manner as to obtain the secondary fluid at a pressure greater than that of the primary fluid. The term "hydraulic fluid" as used herein can refer to any liquid although, for the purposes of this description, the primary purpose of the invention can be understood to be the generation of elevated water pressures (i.e. the secondary fluid is water) by a hydraulic medium such as oil at a lower pressure.

Thus the invention relates more particularly to a pressure amplifier capable of supplying a continuous flow of water at a high pressure for use in applications such as the drilling of holes in rock or the cutting of rock and other materials either with the aid of mechanical means or tools operated by the water flow, or by the water jet itself in which case the nozzle can be the tool.

BACKGROUND OF THE INVENTION

Generally relatively high water pressure for the purposes described has been obtained heretofore by mechanically driven piston pumps. The piston pumps which have been used previously usually can only supply pressures below 2500 bar and are not only quite sizable, but also relatively expensive so that their versatility is greatly limited. It is also difficult to maintain a constant speed of such pumps, so that the flow will be constant, without special equipment.

Hydraulic pressure accumulators with which much higher water pressures can be obtained, e.g. pressures of the order of 4000 bar, have been provided heretofore with pistons which are hydraulically reciprocated in respective cylinders and which carry plungers displaceable in their cylinders and serving to alternately displace the water through valve systems to the discharge passage.

The pressure used to drive the piston is oil, for example, under pressure from a motor-driven pump. These pressure amplifiers have a ratio of the effective cross section of the piston to that of the plungers of the order of 10:1 to 20:1 and thus are capable of similarly modifying the pressure between the primary fluid and the secondary fluid.

In pressure amplifiers of this type, mechanical or electric sensors monitor the approach of the piston to the end of its path in each direction of travel and provide an appropriate signal or pulse to operate the valves or distributors reversing the fluid feed to the chambers of the cylinder in which the piston is reciprocated.

OBJECTS OF THE INVENTION

The principal object of the present invention is to provide an improved pressure amplifier of relatively simple construction and in which detectors of the type described at the ends of the path of the piston are eliminated and, consequently, the collateral elements operated by these sensors are likewise eliminated.

Another object of the invention is to provide an improved pressure amplifier for the purposes described in which the displacement of the piston is controlled by the piston itself and purely hydraulically without the aforementioned sensors or the like.

SUMMARY OF THE INVENTION

These objects and others which will become apparent hereinafter are attained in accordance with the present invention in a hydraulic pressure amplifier which comprises a stepped piston mounted so as to shift axially within the interior of a cylinder so as to define therein a first annular chamber of relatively small cross section permanently connected to a source of a primary fluid under pressure and a second annular chamber of much larger cross section connected to a control valve, preferably of the sliding-spool type, having different sections alternately connecting the second annular chamber with a return passage for the fluid and with the source of the primary fluid under pressure.

The valve is controlled, in turn, by the primary fluid via a single passage which opens in the cylinder and is alternately unblocked and blocked by the piston. The piston is extended along its axis at its two ends by two plungers of much smaller cross section projecting into two chambers connected between a secondary fluid source and the output passage via respective valves, e.g. check valves which permit the secondary fluid to pass from the source into the plunger chambers and then permit the displaced secondary fluid to flow to the discharge passage.

Thus the primary fluid whose energy is transmitted to the piston also ensures the switching over of the positions of the control valve by purely hydraulic means to the point that all mechanical or electrical detectors for the end position of the valve and controlled by such sensors can be eliminated. When the piston is displaced in one direction toward one of its end positions, the piston itself automatically causes the displacement of the valve spool to modify the hydraulic branching and thus reverse the direction of displacement of the piston.

The piston thus describes a back-and-forth movement to allow displacement of water alternately by the plungers and also cause the reversal of the directions in which the pilot valve spool is displaced automatically and solely by the hydraulic pressures of the primary fluid. Advantageously the piston and its plungers form a monoblock or unitary structure in which the plungers participate in defining the annular chambers previously mentioned.

In a particularly advantageous mode, the piston has a cylindrical part of an intermediate diameter around which the primary annular chamber of the cylinder is formed, a cylindrical part of small diameter about which the second annular chamber is formed and third part forming the aforementioned large diameter or effective section part of the piston.

Preferably the cross section of the first annular chamber is equal to half the exposed piston cross section in the second annular chamber of the cylinder. This allows the primary fluid to generate equal and opposite forces on the piston and thus ensures that the pressures generated in the secondary fluid, i.e. the water, by the plungers will be the same.

In its first direction of displacement, only the primary annular chamber of the cylinder is connected to the source of primary fluid under the pressure while the secondary chamber is connected to the return passage. For displacement in the opposite direction, both the primary chamber and the secondary chamber are connected to the source of primary fluid under pressure so that the piston is differentially driven and the two plungers symmetrically receive the same pressure developments in both the forward and return movements of the piston assuming, of course, that the cross sections of the plungers and their cylinders are equal.

According to another feature of the invention, the large diameter portion of the piston is formed with a downwardly open circumferentially annular groove while the wall of the cylinder has an orifice connected to a return passage for the primary fluid and located so as to communicate in one end position of the piston with this groove and via this groove with a passage controlling the pressurization of the valve and the displacement of the spool valve member.

The control valve comprises a spool or slider having two intermediate lands of relatively large diameter or effective cross section, two ends of much smaller but preferably different cross sections and a central region which can be of smaller cross section.

The valve member is mounted slidably in a hollow or cavity around the valve member, e.g. a cylinder, formed with three annular distribution chambers connected respectively to the source of primary fluid under pressure, to the return passage for this fluid and the second annular chamber of much larger cross section of the cylinder. A fourth annular chamber is likewise provided around one of the small-section ends of the valve spool to communicate with the pilot passage.

According to the invention, the third chamber, depending upon the position of the valve member, is connected to the first distribution chamber, or to the second distribution chamber.

The two extremities of the smaller cross section of the valve spool may have different cross section, as noted, and can be mounted slidably in respective cylindrical chambers of corresponding dimensions and to each of which the primary fluid under pressure is continuously admitted. These cylindrical chambers are interconnected by a passage extending axially through the valve spool and can be connected to the source by a radial bore in the spool which communicates with the axial passage and is continuously connected with the annular chamber of the valve to which fluid under pressure from the source is continuously supplied.

By the differential pressure effect, because of the differences in the cross sectional areas of these sections of the valve spool, the valve spool is pushed into one extreme position by the pressure of the primary fluid on its two ends when the pilot chamber is not under pressure.

Consequently, only a single pilot orifice is required in the cylinder of the piston and in the valve, bridged by the pilot passage to generate a pressure in the valve which displaces the valve toward its opposite position for reversal of the piston. The pilot passage of the control valve is advantageously connected, preferably permanently (continously), to an accumulator which maintains the pilot chamber under pressure throughout the movement of the piston and compensates for internal leakage.

Another accumulator can be connected to the primary or first annular chamber of the cylinder in a permanent manner. This other accumulator is connected also to the second annular chamber of the cylinder when the latter is connected to the source of primary fluid under pressure by the control valve. This second accumulator damps the piston mevements at the end of the path and returns energy to the piston at the moment it begins to move in the opposite direction.

It has been found to be advantageous to provide around the piston and/or the plungers between the cylinder and the two plunger chambers, two annular auxiliary chambers with vents or discharge passages designed to avoid any mixing of the circulated primary fluid and the delivered secondary fluid. With respect to the secondary fluid network, the outlets of the two plunger chambers fed with this fluid are connected by a common outlet passage or duct which is connected, in turn, with a third pressure accumulator so that in spite of pulsing of the secondary fluid by the accumulator, a substantially continuous flow of it is transmitted to the jet nozzle or to the tool operated by the high pressure water.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
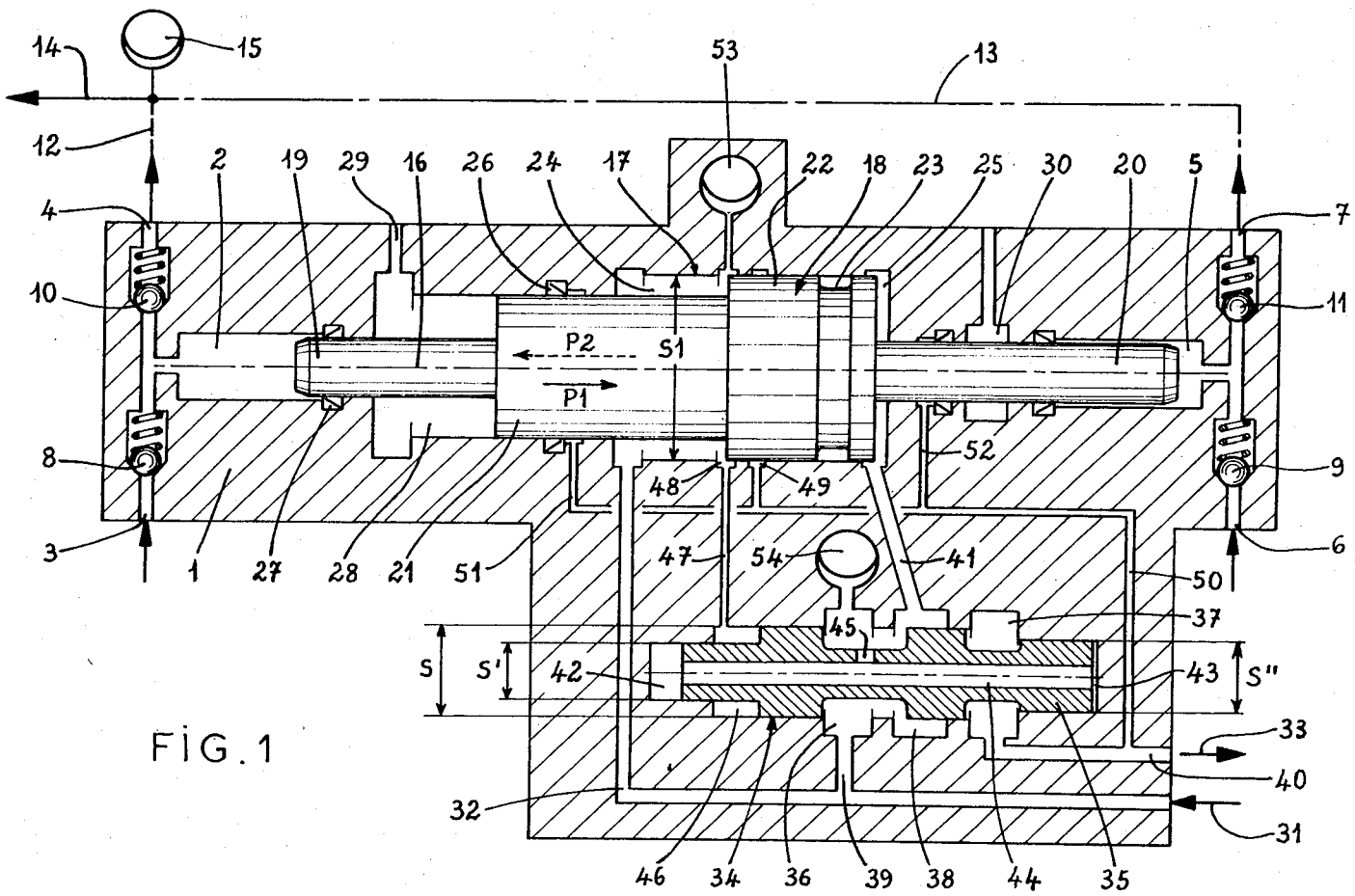
FIG. 1 is an axial section diagrammatically showing a pressure amplifier according to the invention with the piston in one of its end positions.

The hydraulic pressure amplifier shown in the drawing is used to supply a flow of water at high pressure to a load or other utilizer to which the accumulator is connected at 14.

The pressure accumulator comprises a housing or body 1, at one end of which is formed a first cylindrical plunger chamber 2 communicating by an inlet 3 and a check valve 8 with a source of water and having a first outlet 4 communicating with the conduit 14 by the check valve 10.

At the opposite end of the body 1, a second cylindrical plunger chamber 5 is provided in axial alignment with the first plunger 2 and communicates via a second water inlet orifice 6 with the water source while an outlet 7, likewise connected to the conduit 14, is provided for this chamber. The inlet and outlet are provided with check valves 9 and 11 allowing unidirectional flow of water toward the conduit 14. Passages or conduits 12 or 13 connect the outlets 4 and 7, respectively, with the single high pressure conduit 14. An accumulator 15 is provided at the beginning of this latter conduit.

The two cylindrical chambers 2, 5 have the same cross section and are axially aligned with a cylinder 17 formed in the body 1 along the axis 16.

The interior of cylinder 17 slidably receives a piston 18 which is axially extended at its ends by two opposite plungers 19, 20 forming a monoblock or unitary structure with the piston 18. The first plunger 19 extends into the first plunger chamber 2 while the second plunger 20 extends into the second cylindrical plunger chamber 5.

The piston 18 is a stepped piston with a cylindrical part 20*a* of small diameter, a cylindrical part 21 of intermediate diameter and a cylindrical part 22 of the largest diameter and in which is formed an annular groove 23 opening outwardly.

This piston 18 defines within the cylinder 17 a first annular chamber 24 of effective cross-sectional areas S1 located around the intermediate part 21 and a second annular chamber 25 located around the small diameter section 20*a* and represented by the surface area S2 of the annular chamber 25 applied to the right-hand side of the piston 18 and thus effective to the left. This area is twice the area of the effective surface area S1 applied to the left-hand side of the piston 18 and thus effective toward the right upon pressurization of the respective chambers.

The plungers 19 and 20 have still smaller diameters and thus smaller effective cross sectional areas.

Between the cylinders 17 and the first cylindrical chamber 2, and more particularly between the two seals 26, 27, there is formed an auxiliary annular chamber 28 with a discharge or venting orifice 29 preventing mixing of the two fluids under pressure. A similar auxiliary annular chamber 30 is provided along the plunger 20 for the same purpose. This auxiliary chamber is provided between the cylinder 17 and the second plunger chamber 5.

The cylinder 17 is provided to receive a hydraulic fluid or oil, referred to herein as the primary fluid and adapted to displace the piston 18 alternately to the right and to the left.

The first annular chamber 24 whose effective surface S1 is effective to the right is connected continuously to a source of the oil under pressure represented at 31 by a passage 32.

The second annular chamber 25 whose effective surface S2 applies force to the left upon the piston is connected alternately to the source of oil under pressure represented at 31 or to a return line 33 which returns the oil to the reservoir from which the pressure pump draws it, depending upon the position of a control valve 34.

The control valve 34 comprises a spool valve member 35 slidable in a cavity of the body 1 forming around the spool 3 coaxial distribution chambers 36, 37, 38.

A first distribution chamber 36 is connected by a passage 39 to a point of the passage 32 applied with the oil under pressure. A second distribution chamber 37 is connected via a return passage 40 to the conduit 32 returning the oil to the reservoir. A third distribution chamber 38 located between the first and second distribution chambers is connected by a passage 41 to the second annular chamber 25 of cylinder 17.

The spool member 35 comprises two intermediate lands of large diameter and hence large effective cross section as diagrammatically represented at S. In addition, the member 17 has a small diameter end with an effective surface area represented at S′ and a larger diameter opposite end S″. The small diameter end is received in a cylindrical chamber 42 and the opposite end in a cylindrical chamber 43.

The spool valve member 35 is also formed with an axial bore 44 which extends from one end to the other end communicates via a lateral bore 45 with the first distribution chamber 36.

Around the first extremity of the spool member 35 there is also formed an annular chamber 46 communicating with the cylinder 17 by the single pilot or control conduit or passage 47 opening at an orifice 48 into the cylinder which is located at a point intermediate the length of cylinder 17 and such that this orifice is unblocked by the large step 22 of the piston 18 when the piston is in its extreme right-hand position (FIG. 1).

Figure 2:
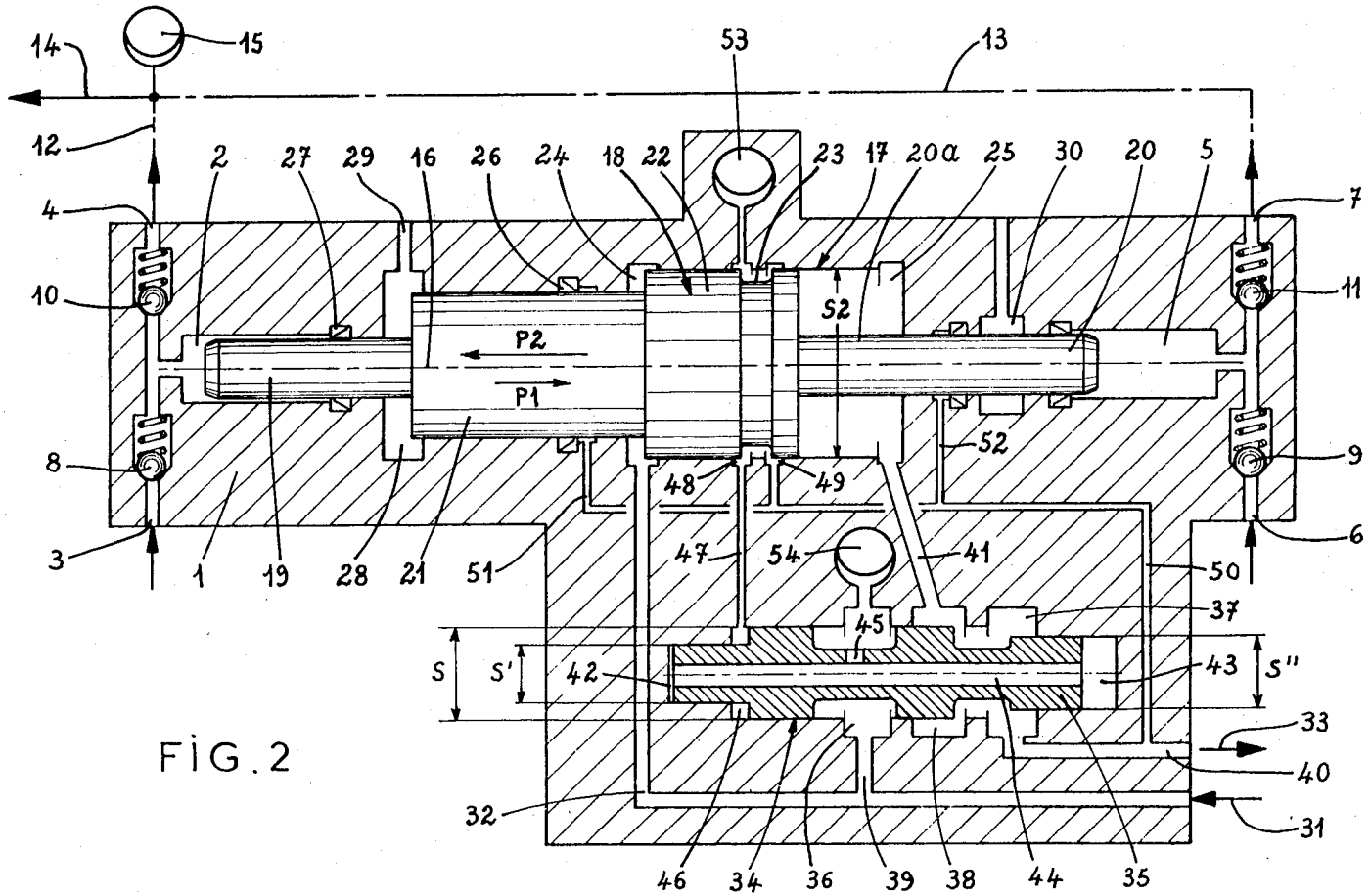
FIG. 2 is a view similar to FIG. 1 but showing the piston in its opposite end position.

Another orifice 49 of the cylinder 17, spaced from the close to the orifice 48, serves to connect the return passage 50 to this cylinder and is connected with the orifice 48 by the annular groove 23 in the other extreme position of the piston 18 (FIG. 2).

Two other passages 51 and 52 have their starting points in the region of the seals, such as seal 26, and are connected to the return passage 50 to drain the primary fluid back to its reservoir 33 immediately upstream of each seal.

Finally, the apparatus comprises two accumulators 53, 54, each of which can serve as a pressure storage unit and can have a gas chamber separated from the liquid chamber by a membrane as is conventional with hydraulic pressure accumulators. A first of these accumulators 53 is connected with the cylinder 17 and with the pilot orifice 48 via an annular groove which surrounds the large diameter step 22 of the piston 18 even when the latter is in its left-hand position shown in FIG. 2. The second accumulator 54 is connected with the passage 32 supplying the oil under pressure, e.g. via the passage 39 and the annular chamber 36 of the valve assembly.

The functioning of the apparatus is of course determined by the differential piston action of both the pressurizing piston 18 and of the valve member 35 in the following manner:

The pressure of the primary fluid or oil in the first annular chamber 24 of the cylinder 17 applies a force to the area S1 biasing the piston 18 always to the right (P1). If the second annular chamber 25 of cylinder 17 is connected to the reservoir, there is no opposing hydraulic force on the piston 18 and the piston is driven to the right to drive water from the plunger chamber 5 to the outlet conduit 14. The force applied in this direction is equal to the product of the oil pressure and the effective area S1 and the pressure developed in the water is equal to this force divided by the area of the plunger 20.

When the hydraulic pressure of the oil is also applied to the annular chamber 25, the pressure generated in the direction of arrow P2 is applied to the larger surface area S2 so that a force twice as great is applied to oppose the biasing force. The force driving the piston 18 to the left is equal to the product of the primary fluid pressure and the difference between the areas S2 and S2 (this difference being equal to the area S1 when S2 is twice S1) so that the force applied to the water in plunger chamber 2 is equal to that which was applied to the water in chamber 5. The pressure generated in the water, of course, is equal to this force divided by the area of plunger 16.

The forces which displace the piston, therefore, are in ratios which are determed by the areas S2 and S1.

With respect to the valve 34, it should be noted that the axial passage 44 and the orifice 45 of the spool 35 ensure that the oil pressure will be applied continuously to both cylindrical chambers 42 and 43 receiving the ends of the spool 35. If the annular chamber 46 is connected to the reservoir 33, the valve member 35 receives a net force to the left owing to the difference in surface areas S′ and S″.

When the annular chamber 46 is under the pressure of the oil, it contributes a force proportional to the area S which in conjunction with the force contributed by the area S′ exceeds the force attributable to the area S″ and the valve member 35 is displaced to the right. It is thus apparent that the switching of the valve 35 between its extreme positions will depend upon the pressure in annular chamber 46 as controlled by the single pilot passage 47 and thus whether the orifice 48 is connected to the oil pressure source 31 (FIG. 1) or is connected to the orifice 49 by the groove 23 (FIG. 1). As the piston 18 is displaced from left to right, therefore, toward the end of its stroke there reaches a point at which the orifice 48 will be unblocked and pressure from source 31 will be applied to pressurize the chamber 46 and drive the valve 35 to the right. This connects the oil pressure to passage 41 and chamber 25 (FIG. 1) so that piston 18 is now differentially displaced toward the left.

When the piston 18 reaches its other extreme position (FIG. 2) the groove 23 interconnects the orifices 48 and 49 to now drain the chamber 46, thereby permitting the valve 35 to be differentially displaced toward the left, connecting the passage 41 with the chamber 37 and the reservoir 33. As a consequence, chamber 25 is relieved and the cycle can repeat.

During movement of the piston 18 toward the right, the orifice 48 is blocked except for its communication with the accumulator 53 so that the valve member 35 is held in the positoin shown in FIG. 1 until the piston 18 reaches its limiting position. Similarly, during movement of the piston 18 to the left, the orifice 48 is blocked to retain the valve member 35 in its other extreme position until the piston 18 reaches its other limiting position. The result is an alternating movement of the piston 18 along the axis 16 in the cylinder 17 to displace the two plungers 19 and 20 in the respective plunger chambers 2 and 5 to thereby vary the volumes of these chambers. This movement of the two plungers associated with the functioning of the valves 8–11 permits alternate induction and discharge of water from the chambers so that the water is pumped at high pressure into the conduit 14. In spite of the pulsing nature of the pumping action, the flow can be more or less continuous by reason of the accumulator 15. The high pressure jet of water, e.g. at a pressure of say 4000 bar, can provide a cutting jet which can be used in mining applications for rock drilling either alone or as an operating force or medium for a mechanical drilling tool.

The accumulator 53 associated with the pilot passage 47 permits stabilization of the pressure in the annular chamber 46 and thus eliminates the effect of internal oil leakage of the operation of the valve 34. The accumulator 53 permits the stroke of the piston 18 to be relatively large and its velocity to be relatively small.

The accumulator 54 serves to damp the movement of the piston 18 when it reaches its extreme positions by accumulating energy and restoring it to the piston.

The plungers 51 and 52 relieve the seals (such as seal 26) from pressure during operation of the apparatus and thus reduce the friction on the piston 18 so that the output is not thereby limited.

It will also be apparent that the invention is not limited to the single embodiment of the amplifier described and indeed embraces all variants in applications of the invention utilizing the principles of the invention.

For example, the positions of the accumulators or dampers 53, 54 can be varied without changing their relations to other elements or other functions. It is also possible to use other liquids than oil and water as the primary and secondary fluids and indeed the two fluids can be of the same type if the application requires it.

I claim:

1. A hydraulic pressure amplifier comprising:

a cylinder provided at opposite ends with plunger chambers of smaller cross section and said cylinder and coaxial therewith;

a piston displaceable in said cylinder and formed at opposite ends with respective plungers extending respectively into said plunger chambers and lying along the axis of said piston, said piston being stepped and defining in said cylinder a first annular chamber of relatively smaller effective cross section continuously connected to a source of a primary fluid under pressure, and a second annular chamber of large effective cross section;

a pilot valve formed with a valve member differentially displaceable and connected with said second annular chamber for alternately connecting same with said source and with a return passage for said primary fluid;

means forming a single pilot passage communicating with said cylinder at an orifice disposed at an intermediate location along the length of said cylinder and alternately uncovered and blocked by said piston, said pilot passage being connected to said pilot valve to control the fluid pressure differential displacement of said valve member; and respective check valves allowing a secondary fluid to be induced into said plunger chambers and driven therefrom at high pressure.

2. The hydraulic pressure accumulator defined in claim 1 wherein said piston and said plungers form a unitary structure.

3. The hydraulic pressure accumulator defined in claim 1 wherein the pilot passage is continuously connected to a hydraulic pressure accumulator.

4. The hydraulic pressure accumulator defined in claim 1, further comprising a hydraulic pressure accumulator connected to said first annular chamber continuously and to said second annular chamber when the same is connected with said source by said pilot valve.

5. The hydraulic pressure accumulator defined in claim 1, further comprising auxiliary annular chambers disposed between said first and said second annular chambers and the respective plunger chambers and provided with venting passages.

6. The hydraulic pressure accumulator defined in claim 1 wherein said plunger chambers have outlets connected to a common conduit, further comprising an accumulator connected to said conduit where said conduit is connected to said outlets.

7. The hydraulic pressure accumulator defined in claim 1 wherein said plunger chambers have inlets connected to a source of water for delivering water under pressure to a tool for the perforation of rock.

8. The hydraulic pressure accumulator defined in claim 1 wherein said piston has a cylindrical part of an intermediate diameter around which said first annular chamber is formed and a cylindrical part of small diameter around which the second annular chamber is formed.

9. The hydraulic pressure accumulator defined in claim 8 wherein the effective area of said first annular chamber is equal to half the effective area of said second annular chamber.

10. The hydraulic pressure accumulator defined in claim 8 wherein said piston further comprises a large diameter cylindrical part between said part of intermediate diameter and said part of small diameter and formed with an annular groove, said cylinder having a wall formed with a further orifice proximal to the orifice of said pilot passage and communicating therewith via said groove in one extreme position of said piston, said further orifice being connected to a return path for said primary fluid.

11. The hydraulic pressure accumulator defined in claim 1 wherein said valve member of said pilot valve comprises two intermediate lands of relatively large cross section and two extremities of smaller cross sections, said member being slidably mounted in a cavity formed around said member and defining three annular distribution chambers connected respectively to said source, to said return path and to said second annular chamber, a fourth annular chamber being formed in said cavity and being connected to said pilot passage, said member connecting the third of said chambers according to the position of said member with the first of said chambers and with the second of said chambers, selectively.

12. The hydraulic pressure accumulator defined in claim 11 wherein said extremities have different effective surface areas and are mounted slidably in respective cylinder diameters of corresponding cross section maintained continuously under the pressure of said primary fluid.

13. The hydraulic pressure accumulator defined in claim 12 wherein said member is provided with an axial passage interconnecting the chambers receiving said extremities and communicating with said first distribution chamber by a bore opening at a lateral surface of said member.

* * * * *